US011747120B1

(12) United States Patent
Taylor-Power et al.

(10) Patent No.: US 11,747,120 B1
(45) Date of Patent: Sep. 5, 2023

(54) NOSECONE AND TAILFIN STRUCTURES FOR AN AERODYNAMIC SYSTEM

(71) Applicant: BAE Systems Information and Electronic Systems Integration Inc., Nashua, NH (US)

(72) Inventors: Gregory Taylor-Power, Middleton, NH (US); Ross T. Johnson, Nashua, NH (US); Gregory B. Lombard, Plaistow, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 187 days.

(21) Appl. No.: 17/345,151

(22) Filed: Jun. 11, 2021

(51) Int. Cl.
*F42B 10/06* (2006.01)
*F42B 10/46* (2006.01)
*F42B 15/01* (2006.01)

(52) U.S. Cl.
CPC ..... *F42B 10/06* (2013.01); *F42B 10/46* (2013.01); *F42B 15/01* (2013.01)

(58) Field of Classification Search
CPC ..... F42B 10/06; F42B 10/46; F42B 15/01
See application file for complete search history.

(56) References Cited

U.S. PATENT DOCUMENTS

| | | | | |
|---|---|---|---|---|
| 3,378,216 | A * | 4/1968 | Oss | F42B 10/06 D19/138 |
| 4,158,447 | A * | 6/1979 | Humphries | F42B 10/16 244/3.29 |
| 8,674,277 | B2 * | 3/2014 | Axford | F42B 10/64 102/501 |
| 9,568,280 | B1 * | 2/2017 | Perryman | F42B 10/46 |
| 9,969,491 | B2 * | 5/2018 | Strayer | B63G 3/04 |
| 2016/0178317 | A1 * | 6/2016 | Powell | F41F 3/07 89/1.813 |
| 2019/0107372 | A1 * | 4/2019 | Liptaak | F42B 10/46 |
| 2021/0278180 | A1 * | 9/2021 | Paulic | F42C 19/06 |

* cited by examiner

*Primary Examiner* — Brady W Frazier
*Assistant Examiner* — Shanna Danielle Glover
(74) *Attorney, Agent, or Firm* — Finch & Maloney PLLC; Gary McFaline

(57) ABSTRACT

Nosecone and tailfin designs for aerodynamic systems are disclosed. The designs increase the usable volume within the fuselage of the aerodynamic system while still maintaining the same length for the aerodynamic system. In an example, the nosecone is truncated and includes a blunted tip compared to standard nosecone designs, which allows for more useable space along the length of the aerodynamic system. A tailfin structure is fabricated as a separate piece (separate from the fuselage of the aerodynamic system) and slips over a portion of one end of the fuselage, thus allowing useable volume within the fuselage beneath the tailfin structure. The tailfin structure also includes a hollow cavity for holding componentry (e.g., an RF transmitter, receiver, or transceiver device) with wires that feed through the tailfin structure and into the fuselage of the aerodynamic system.

19 Claims, 6 Drawing Sheets

NOSECONE AND TAILFIN STRUCTURES FOR AN AERODYNAMIC SYSTEM

STATEMENT OF GOVERNMENT INTEREST

This invention was made with United States Government assistance under Contract No. N00019-19-C-1025, awarded by the United States Navy. The United States Government has certain rights in this invention.

BACKGROUND

Many aerodynamic systems such as certain types of rockets and projectiles are constrained in size based on the size of the corresponding launch tube or transportation platform that contains the aerodynamic system. However, there are typically many electronic systems and other payloads included within the aerodynamic system, so space constraints for all of these components can become an issue. Creative designs are needed that allow for an increase in the usable volume within these aerodynamic systems, as they cannot simply be made larger.

BRIEF DESCRIPTION OF THE DRAWINGS

Features and advantages of embodiments of the claimed subject matter will become apparent as the following Detailed Description proceeds, and upon reference to the Drawings, in which:

Figure 1A:
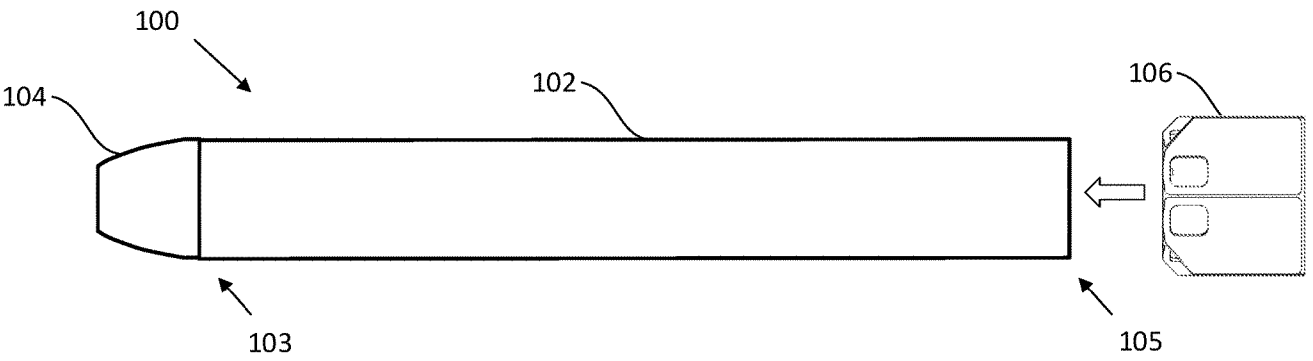
FIGS. 1A-1C illustrate an example aerodynamic system configured in accordance with an embodiment of the present disclosure, and further collectively illustrate an example assembly process for a tailfin and transmitter assembly of the aerodynamic system, in accordance with an embodiment of the present disclosure.

Although the following Detailed Description will proceed with reference being made to illustrative embodiments, many alternatives, modifications, and variations thereof will be apparent in light of this disclosure.

DETAILED DESCRIPTION

Nosecone and tailfin designs for aerodynamic systems are disclosed. The designs increase the usable volume within the fuselage of the aerodynamic system while still maintaining the same length for the aerodynamic system. In some examples, the designs, in combination with an increase in the outer diameter of the aerodynamic system fuselage, yield an increase of the internal volume within the aerodynamic system of about 50%. According to some embodiments, the nosecone is truncated and includes a blunted tip compared to standard nosecone designs, which allows for more useable space along the length of the aerodynamic system. According to some embodiments, a tailfin structure is fabricated as a separate piece, and slips over a portion of one end of the aerodynamic system fuselage, thus allowing useable volume within the fuselage beneath the tailfin structure. The tailfin structure also includes a hollow cavity for holding, for example, a radio frequency (RF) communication device (e.g., transmitter, receiver, or transceiver) with wires that feed through the tailfin structure and into the fuselage of the aerodynamic system. Numerous embodiments and variations will be appreciated in light of this disclosure.

General Overview

As noted above, it is becoming increasingly important to increase the internal packing volume within many types of aerodynamic systems. In some example cases, the aerodynamic system is a guided munition or projectile such as a bullet, shell, missile, torpedo, or rocket, to name a few examples. For many guided munitions or projectiles, the fuselage and/or nosecone region includes many components such as a particular payload, guidance electronics, heat dissipation structures, RF electronics, and/or antennas to name a few examples. In such cases, note the payload carried by the aerodynamic system can vary from one application to the next, and need not be limited to explosives or lethal payloads. For instance, the payload could be supplies (e.g., food, equipment), personnel, communications gear (e.g., to provide an airborne communications node over a given region), imaging gear or other sensor-based gear (e.g., weather sensors such as for temperature and humidity, gas sensors, speed sensors), illumination gear (e.g., to illuminate an area with visible light), and surveillance gear, to name a few examples. Accordingly, designing the aerodynamic system in such a way that increases the internal volume is highly beneficial as it allows the aerodynamic system to include more and/or larger components. However, many aerodynamic systems involve non-trivial issues with respect to aerodynamic performance, thereby precluding trivial design choices for suitable approaches, such as elongating the fuselage of aerodynamic system, or encumbering the external surface of the aerodynamic system. In this sense, there are many constraints and obstacles that preclude the freeing of internal volume.

Accordingly, the present disclosure provides both nosecone and tailfin designs suitable for use on aerodynamic systems while maintaining aerodynamic performance. According to some embodiments, a truncated, blunted nosecone design is used in conjunction with a modular tailfin structure, which in turn allows for more internal volume along a length of the fuselage. In some other embodiments, the tailfin structure can be used on its own, without the truncated, blunted nosecone design. In either case, the tailfin structure slips over an end of the aerodynamic system fuselage to provide additional internal volume within the fuselage under the tailfin structure. In some embodiments, the tailfin structure also includes a cavity for holding a transmitter (or transceiver) device that would have otherwise been included within the fuselage. The tailfin structure is a modular component in that it can be attached and detached from the fuselage without breaking down any part of the fuselage, according to some embodiments. The nosecone can be blunted such that it has a substantially circular front-facing surface with a radius that is about half a radius of a cross-section across the fuselage. Additionally, the nosecone can be constructed from a heavy base material and a lighter polymer material at the tip. According to some embodiments, the tailfin structure includes a cylindrical wall with a plurality of panels coupled to an outer surface of the cylindrical wall. A backplate may be coupled to one end of the cylindrical wall and each of the plurality of panels may be coupled to the backplate as well as to the cylindrical wall. The cylindrical wall is shaped to fit over the end of the fuselage thus allowing the tailfin structure to be a separately machined or otherwise formed structure that slips over the end of the fuselage during assembly of the aerodynamic system. Note that in some embodiments, the tailfin structure is monolithically formed as a unitary mass (single piece of material). In such a case, further note that the tailfin structure still includes a cylindrical wall with a plurality of panels coupled to an outer surface of the cylindrical wall and to a backplate. To this end, the phrase "coupled to" as used in this context is not intended to be limited to separate pieces that are attached to one another. So, for instance, the panels coupled to an outer surface of the cylindrical wall and to the backplate may be part of a single piece of material that includes each of the panels, the outer surface of the cylindrical wall, and the backplate.

According to one example embodiment of the present disclosure, an aerodynamic system includes a fuselage having a cylindrical shape with a first end and an opposite second end, a nosecone coupled to the first end of the fuselage, and a tailfin structure comprising a cylindrical wall, an inner plate coupled to an inner surface of the cylindrical wall, and a plurality of tailfin panels coupled to an outer surface of the cylindrical wall. The tailfin structure is shaped to fit over the second end of the fuselage such that the cylindrical wall wraps around a portion of a length of the fuselage extending from the second end of the fuselage towards the first end of the fuselage. In some examples, a cavity is formed between the inner plate and a backplate coupled to one end of the cylindrical wall. One or more RF communication devices can be placed within the cavity (e.g., transmitter, receiver, or transceiver).

According to another example embodiment of the present disclosure, an aerodynamic system includes a fuselage having a cylindrical shape with a first end and an opposite second end, a nosecone coupled to the first end of the fuselage, and a tailfin structure comprising a plurality of tailfin panels at the second end of the fuselage. The fuselage has a first diameter and the nosecone has a circular front-facing surface with a second diameter that is about half of the first diameter.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous.

Aerodynamic System Overview

Figure 1B:
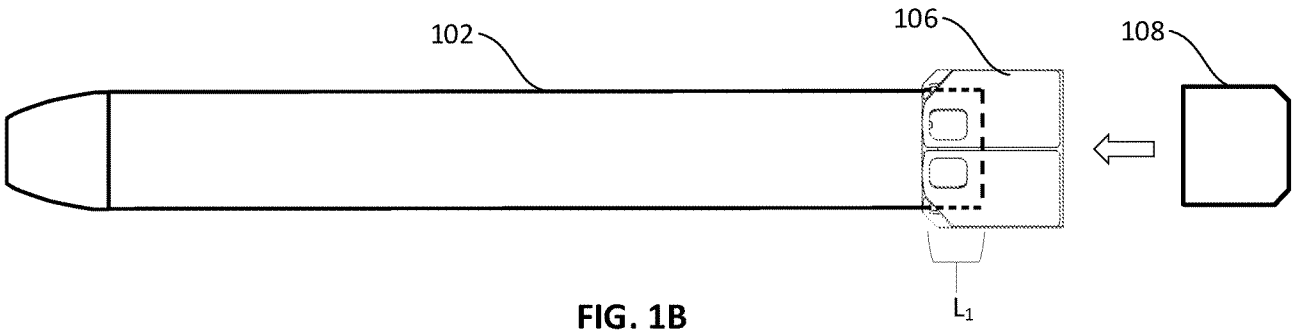
Figure 1C:
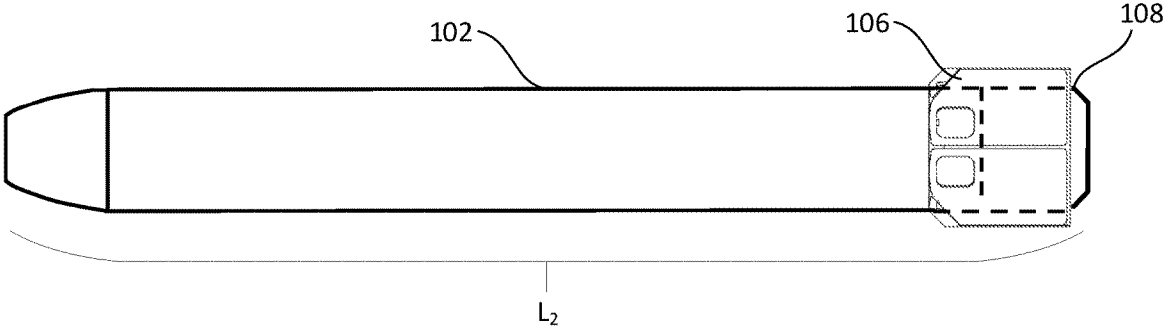

FIGS. 1A-1C illustrate an example aerodynamic system 100, including an assembly process for attaching a tailfin structure 106 to a fuselage 102 of aerodynamic system 100, according to some embodiments. As previously noted, the aerodynamic system 100 may be any caliber or type of projectile that houses payload and/or electrical components, such as RF communication components or other guidance electronics. In one example, aerodynamic system 100 is a guided munition, such as a guided missile or rocket (e.g., surface-to-air, air-to-air, or any other guided munition that communicates with antennas), but other applications will be apparent in light of this disclosure.

According to some embodiments, aerodynamic system 100 includes a fuselage 102 that acts as an outer shell or hull to contain various payloads, electrical, or electromechanical elements of aerodynamic system 100. In some examples, fuselage 102 has a cylindrical shape yielding a substantially circular cross-section. Fuselage 102 may have an outer diameter between about 1.0 inch and about 3.0 inches (e.g., 2.0 inches), according to some example cases, although the present disclosure is not intended to be limited to a particular diameter range. Fuselage 102 may have any number of configurations and may be implemented from any number of materials. For instance, fuselage 102 may be a cylinder of lightweight material such as titanium, aluminum, or a polymer composite. Fuselage 102 may be one monolithic piece of material or may be multiple pieces that are individually formed and then joined in a subsequent process. In a more general sense, fuselage 102 is not intended to be limited to any particular design or configuration, as will be appreciated in light of this disclosure.

According to some embodiments, fuselage 102 includes a first end 103 having a nosecone 104 and an opposite second end 105, over which a tailfin structure 106 can be installed. Nosecone 104 has a blunted tip design as will be discussed in more detail with regards to FIG. 2. According to some embodiments, tailfin structure 106 is fabricated separately from the rest of fuselage 102 using a lightweight material such as aluminum or a dielectric polymer like polyetheretherketone (PEEK). As indicated by the arrow in FIG. 1A, tailfin structure 106 is designed to slip over or slidably engage the second end 105 of fuselage 102. In one example the tailfin structure 106 is a kit or kit assembly that is configured to mount onto the fuselage in the field or when ready to be deployed.

As illustrated in FIG. 1B, tailfin structure 106 is shaped to fit over fuselage 102 such that a portion of tailfin structure 106 wraps around a length $L_1$ of fuselage 102 extending from second end 105 towards first end 103 of fuselage 102. According to some embodiments, tailfin structure 106 includes a cylindrical wall (as best shown in FIGS. 3A-D) that fits around second end 105 of fuselage 102 and an inner plate (as best shown in FIGS. 3A-D) coupled to the cylindrical wall that is adjacent to second end 105 after tailfin structure 106 has been attached. These details of tailfin structure 106 are discussed in more detail with regards to FIGS. 3A-3D. According to some embodiments, the cylindrical wall of tailfin structure 106 fits over a grooved section of fuselage 102 that extends from second end 105 towards first end 103 by about length $L_1$. A plurality of grooves is employed in one example to help guide the tailfin structure 106 onto the fuselage 102. The length $L_1$ of fuselage 102 that includes a portion of tailfin structure 106 around it may be, for instance, between about 1 inch and 2 inches, according to some such embodiments. Although the total length $L_2$ of system 100 can vary from one example to the next, in some embodiments length $L_2$ may be between about 15 inches and about 20 inches (e.g., 17.5 inches). Recall that the inner plate may be integrally formed with the cylindrical wall, such that the inner plate and cylindrical wall are part of a monolithic or unitary mass or otherwise a single piece. In such cases, the inner plate is still considered to be coupled to the cylindrical wall. To this end, the phrasing "coupled to" in this particular context is not intended to be limited to separate pieces that are attached to one another, but may refer to a single monolithic piece of material having the various features (e.g., inner plate, cylindrical wall, small and large tailfin panels).

According to some embodiments, a separate RF unit 108 can be inserted through a backend of tailfin structure 106 as indicated by the arrow in FIG. 1B. As seen in FIG. 1C, RF unit 108 may extend some distance outwards from the end of tailfin structure 106 after being attached. As will be discussed in more detail herein, RF unit 108 in one example includes one or more wires or cables that pass through one or more through-holes in the inner plate within tailfin structure 106 to interface with one or more other electrical components within fuselage 102. Note that RF unit 108 can be an RF transmitter, RF receiver or an RF transceiver, depending on the desired RF function of aerodynamic system 100. RF unit 108 may operate in any known RF band (UHF, SHF, EHF, etc.) In some embodiments, RF unit 108 is replaced with an optical unit for optically communicating with another device.

The RF unit 108 is secured to the tailfin 106 so that it does not rotate or break free from the tailfin. In one example the RF unit is secured with mating threads such that it screws into the interior threaded region of the tailfin. In another example there are fastening holes on both the fuselage and the tailfin assembly such that pins, bolts or screws can be used to secure the RF unit 108 into the tailfin structure 106.

In one example the fuselage 102 includes a seeker assembly such as IR or imaging sensors located proximate the nose or mid-body that are used to provide orientation and to assist in guidance of the projectile to a target. The seeker assembly typically communicates with the guidance, navigation and control (GNC) that processes data to ensure the projectile is on-course to the target and makes appropriate adjustments as needed. The GNC can also include a GPS sensor that can further aid in navigation. The projectile can also include a control actuation system that employs flaperons or wings that extend from the body of the projectile that responds to instructions from the GNC to dynamically control the flight of the projectile by changing a position of the wings. In one example the control actuation system is part of a projectile guidance kit that couples to the fuselage. An example of the above is the APKWS® precision guidance kit.

Figure 2:
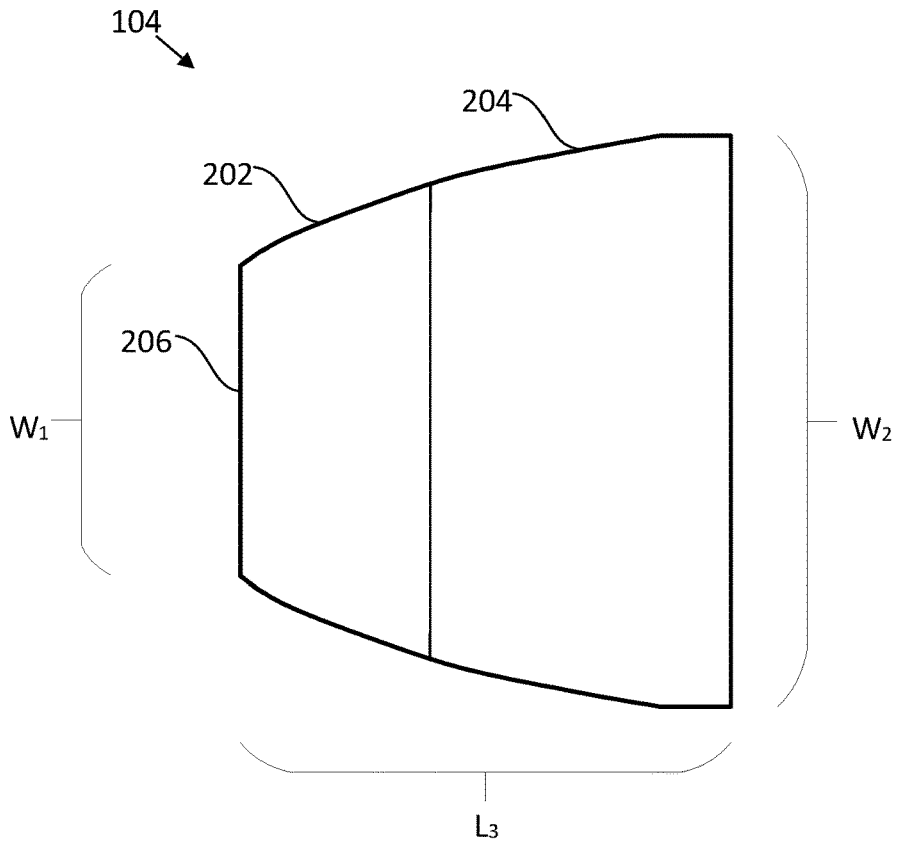
FIG. 2 is a sideview of the nosecone of the aerodynamic system of FIGS. 1A-1C, in accordance with an embodiment of the present disclosure.

FIG. 2 illustrates a side view of nosecone 104, according to some embodiments. According to some such embodiments, nosecone 104 includes a top material layer 202 over a wider base material layer 204, with base material layer 204 being heavier than top material layer 202. In some such examples, base material layer 204 includes tungsten and top material layer 202 includes a dielectric polymer material, such as PEEK. Top material layer 202 may include a polymer material to provide less attenuation for transmitted or received RF signals through top material layer 202.

According to some embodiments, top material layer 202 includes a blunted tip 206 having a circular surface with a diameter $W_1$ that is about half of a diameter $W_2$ of the widest portion of base material layer 204. In some examples, diameter $W_2$ is the same diameter as fuselage 102. Diameter $W_1$ may be, for example, between about 0.5 inches and about 1.5 inches, while diameter $W_2$ may be, for example, between about 1 inch and about 3 inches, according to some embodiments. The length $L_3$ of nosecone 104 may be, for example, between about 1.5 inches and about 2.0 inches, although other embodiments may have geometries suitable for the given application.

Figure 3A:
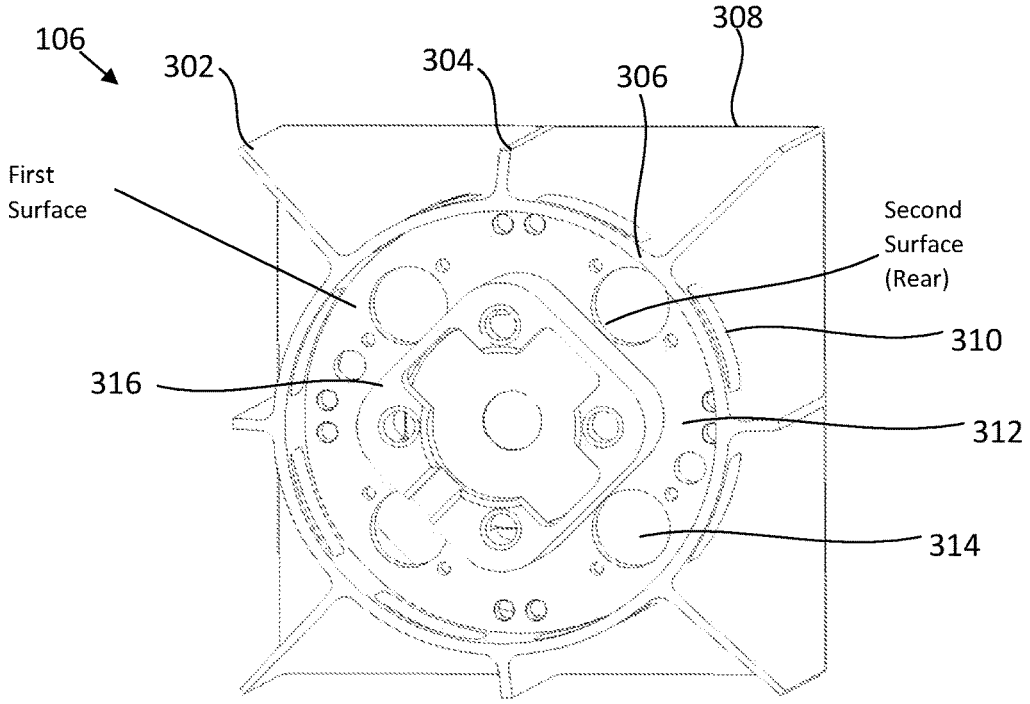
FIGS. 3A-3D illustrate different views of the tailfin structure of the aerodynamic system in FIGS. 1A-1C, in accordance with an embodiment of the present disclosure.

FIG. 3A illustrates an isometric view of tailfin structure 106, according to an embodiment. As can be seen, tailfin structure 106 includes a plurality of large tailfin panels 302 and small tailfin panels 304 arranged around a central cylindrical wall 306. As noted above, cylindrical wall 306 is shaped to fit over one end of fuselage 102. In some embodiments, tailfin structure 106 includes four large tailfin panels 302 and four small tailfin panels 304 that alternate with one another around cylindrical wall 306. Each of large tailfin panels 302 and small tailfin panels 304 may also be coupled to a backplate 308, which itself is coupled to one end of cylindrical wall 306. According to some embodiments, large tailfin panels 302 alternate with small tailfin panels 304 at equal intervals around cylindrical wall 306 (e.g., each fin placed at angle intervals of about 45 degrees).

Between adjacent tailfin panels, one or more windows (openings) 310 may be provided through a thickness of cylindrical wall 306. Windows 310 may be located near a front portion of cylindrical wall 306, such that windows 310 lie over a portion of fuselage 102 after tailfin structure 106 has been attached to fuselage 102. According to some embodiments, windows 310 provide openings for more efficient heat dissipation from the surface portion of fuselage 102 that is covered by cylindrical wall 306.

An inner plate 312 is coupled to an interior surface of cylindrical wall 306. According to some embodiments, cylindrical wall 306 slips over fuselage 102 until the end of fuselage 102 makes contact with one or more portions of inner plate 312. Various types of fasteners can be used between inner plate 312 and the end of fuselage 102 to mechanically join tailfin structure 106 to the end of fuselage 102. Other embodiments may use adhesive or bonding material to secure structure 106 to the end of fuselage 102, or a combination of adhesive/bonding and mechanical fasteners. Since the projectile is subject to vibration and also temperature changes, the tailfin structure 106 is securely coupled to the fuselage 102 such that it does not rotate or decouple during flight. In one example there are fastening holes on both the fuselage and the tailfin assembly such that one or more fasteners (e.g., pins, bolts or screws) can be used to secure the tailfin structure 106 into position. In one embodiment, tailfin structure 106 is secured to the end of fuselage 102 using a bolt that threads through the center of fuselage 102. The same bolt may also be used to attach RF unit 108 to the end of tailfin structure 106. In another example, there are exterior threads on the fuselage and the tailfin 106 screws onto the fuselage 102. In yet a further example, there are lateral grooves such that the tailfin 106 slides longitudinally onto the fuselage 102 and then is twisted to engage the lateral grooves.

According to some embodiments, inner plate 312 also includes one or more through-holes 314 in order to feed wires or cables to any one or more devices on the opposite side of inner plate 312, such as RF transmitter 108. According to some embodiments, inner plate 312 includes a raised structure 316 that may be used to couple with one or more other structures at the end of fuselage 102. In one example the feed wires or cables are used to route power and/or electronics between the RF unit 108 and the electronics in the fuselage.

Recall that the large tailfin panels 302 and small tailfin panels 304 may be integrally formed with the backplate 308 and cylindrical wall 306, such that the large tailfin panels 302, small tailfin panels 304, cylindrical wall 306, backplate 308, and inner plate are part of a monolithic or unitary mass or otherwise a single piece. Or some combination of these features may be part of a unitary mass. To this end, the phrasing "coupled to" in this particular context is not intended to be limited to separate pieces that are attached to one another, but may refer to a single monolithic piece of material having the various features (e.g., backplate, inner plate, cylindrical wall, small and large tailfin panels).

Figure 3B:
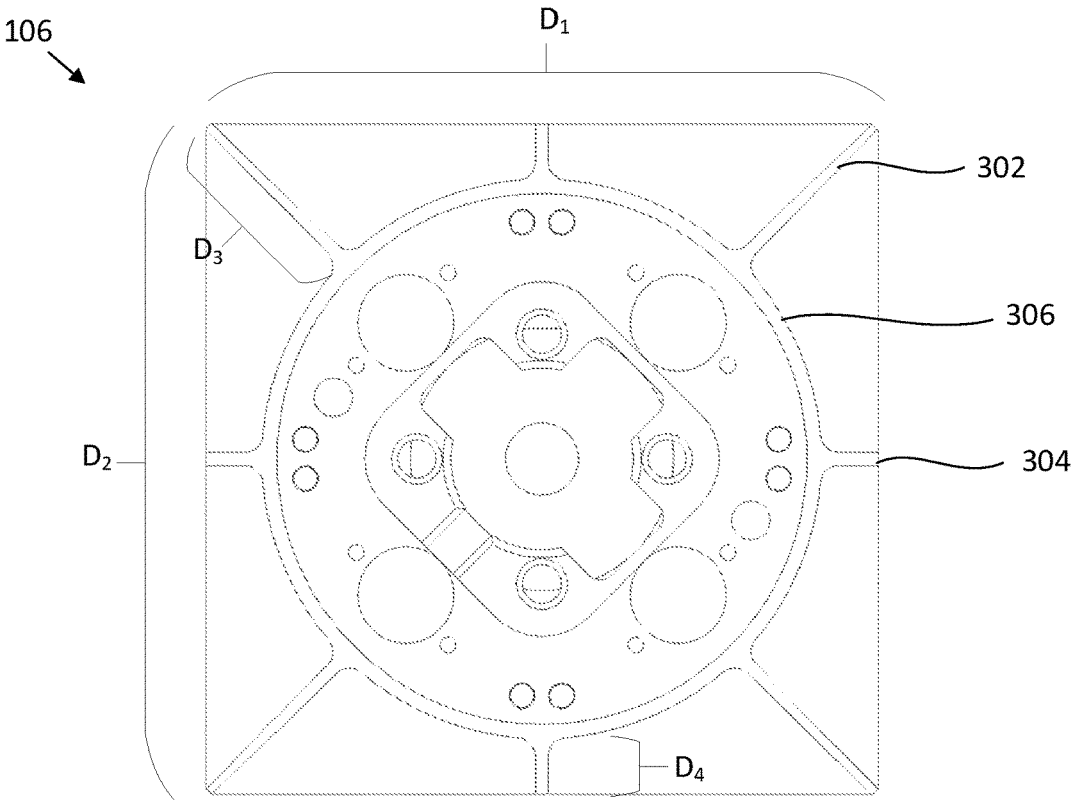

FIG. 3B illustrates a top-down view of tailfin structure 106, according to an embodiment. Tailfin structure 106 may have, for example, an overall width $D_1$ between about 2 inches and about 3 inches (e.g., 2.5 inches) and a height $D_2$ between about 2 inches and about 3 inches (e.g., 2.5 inches), according to some embodiments. In some embodiments, the width $D_1$ is equal to the height $D_2$. Each of large tailfin panels 302 has a length $D_3$ between about 0.5 inches and about 1.0 inches (e.g., 0.735 inches), according to some examples. Large tailfin panels 302 each has a thickness of about 0.05 inches, according to some examples. In some embodiments, the thickness of large tailfin panels 302 is higher (e.g., between 0.15 inches and 0.20 inches) and oscillating heat pipes or annealed pyrolytic graphite are embedded within large tailfin panels 302 to provide better heat dissipation through the tailfins.

Each of small tailfin panels 304 has a length $D_4$ between about 0.175 inches and about 0.275 inches (e.g., 0.215 inches), according to some examples. Small tailfin panels 304 each has a thickness of about 0.03 inches, according to some examples. According to some embodiments, cylindrical wall 306 has an inner diameter of about 2 inches and an outer diameter of about 2.15 inches.

Figure 3C:
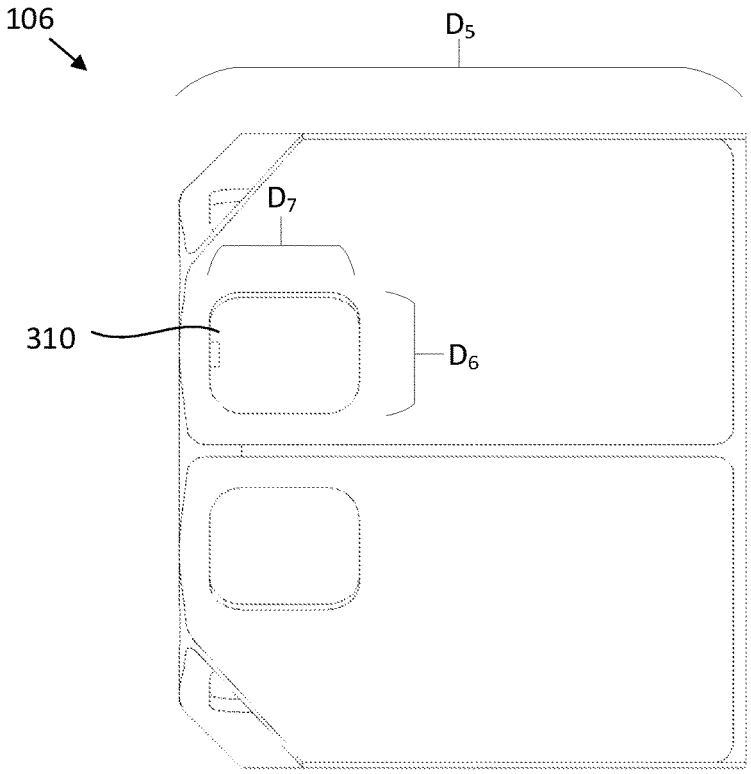

FIG. 3C illustrates a side view of tailfin structure 106, according to an embodiment. Tailfin structure 106 can have a total length $D_5$ between about 2 inches and about 2.5 inches (e.g., 2.3 inches). Each of windows 310 can have a height $D_6$ between about 0.25 inches and 0.75 inches (e.g., 0.54 inches) and a width $D_7$ between about 0.25 inches and about 1.00 inches (e.g., 0.61 inches).

Figure 3D:
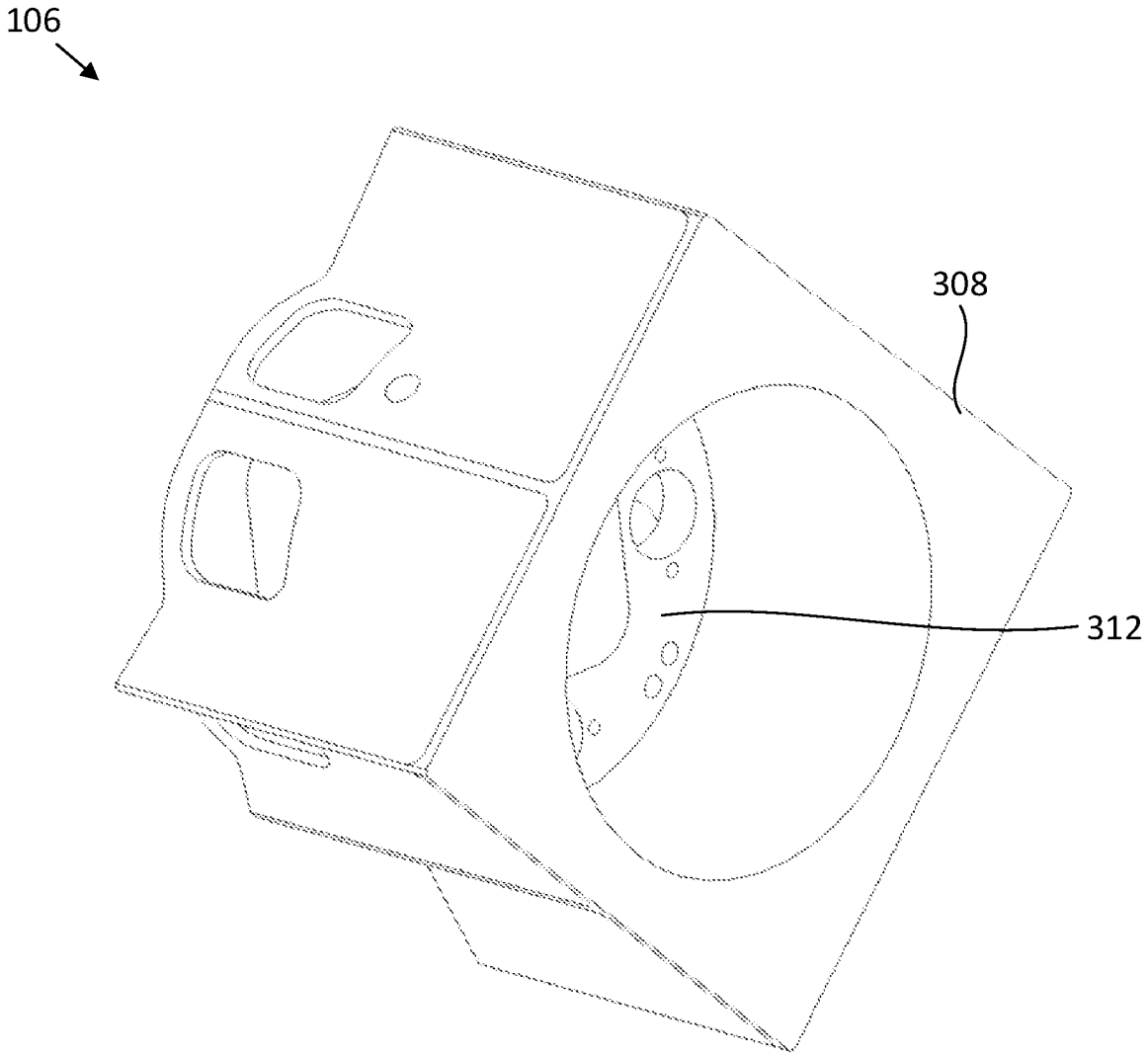

FIG. 3D illustrates another isometric view from the backside of tailfin structure 106, according to an embodiment. A backside surface of inner plate 312 is spaced some distance from backplate 308 to form a cavity. Various electrical and/or communication devices can be placed within the cavity such as RF transmitter 108, according to some embodiments.

Figure 4:
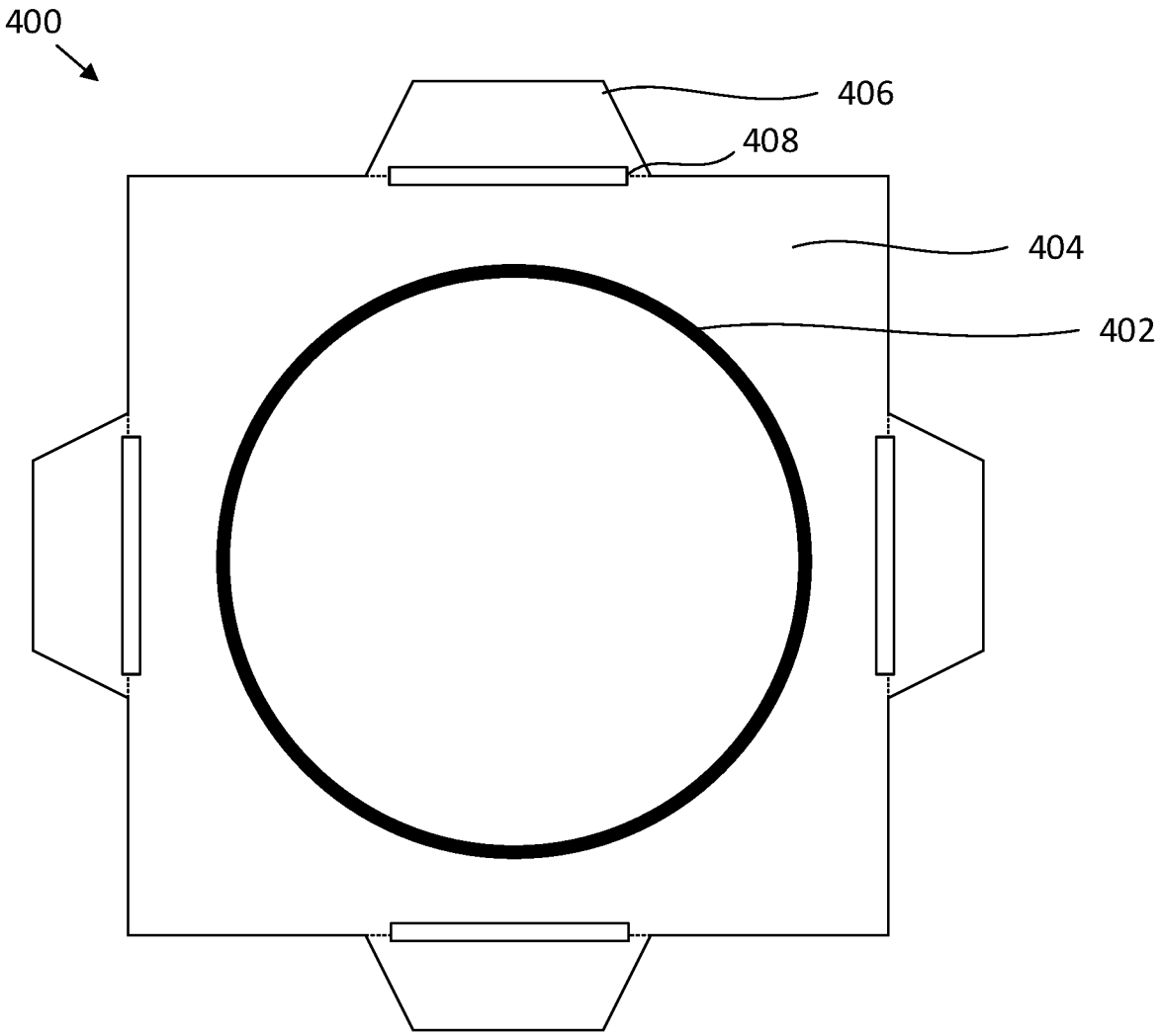
FIG. 4 illustrates a view of another tailfin structure similar to that shown in FIGS. 3A-3D and further having hinged flaps, in accordance with an embodiment of the present disclosure.

FIG. 4 illustrates a top-down view of another tailfin structure 400, according to an embodiment. Tailfin structure 400 may include all or some of the same features as tailfin structure 106, including a cylindrical wall 402 and a backplate 404, and the previous relevant description with respect to tailfin panels 302 and 304, cylindrical wall 306, windows 310, inner plate 312, and through-hole(s) 314, is equally applicable here. So, for instance, although not shown, tailfin structure 400 also includes a plurality of tailfin panels attached to cylindrical wall 402, according to an embodiment. The total number and arrangement of tailfin panels on tailfin structure 400 may be different from those on tailfin structure 106, as will be appreciated in light of this disclosure.

According to some embodiments, backplate 404 includes one or more trapezoidal wings 406 that extend away from one or more sides of backplate 404. Each trapezoidal wing 406 may be coupled to a hinge 408 that allows the trapezoidal wing 406 to flip into an open position (as illustrated) or a closed position towards cylindrical wall 402. Hinge 408 may include a torsional spring. According to some embodiments, each side of backplate 404 includes one trapezoidal wing 406 coupled to a corresponding hinge 408. By flipping open the trapezoidal wings 406 during flight, a resultant increase (~30%) in axial force occurs compared to tailfin designs that do not have the trapezoidal wings 406. According to some embodiments, trapezoidal wings 406 are held in a closed position (by corresponding hinge 408) while aerodynamic system 100 is not in flight, and then are flipped into the open position by forces exerted when aerodynamic system 100 is launched into flight. In another embodiment, trapezoidal wings 406 are held in a closed position (by corresponding hinge 408) while aerodynamic system 100 is stored in a launch tube (e.g., confined by the launch tube) and then are flipped open when the aerodynamic system 100 leaves the launch tube.

Figure 5:
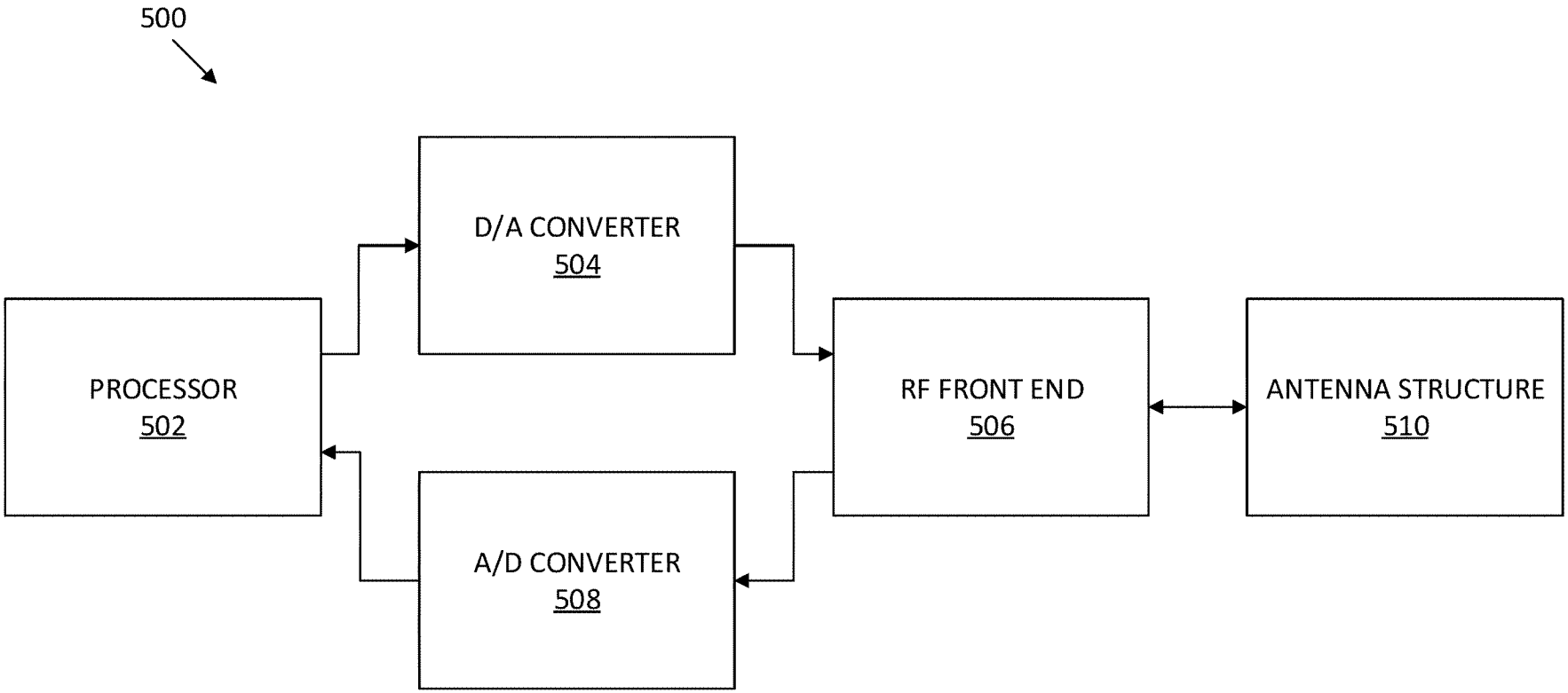
FIG. 5 is a block diagram illustrating a signal processing environment on board the example aerodynamic system of FIGS. 1A-1C, in accordance with an embodiment of the present disclosure.

FIG. 5 illustrates an example RF system 500 that can be used on board aerodynamic system 100 to transmit and/or receive RF radiation, according to some embodiments. According to some such embodiments, the RF radiation is transmitted for guidance, homing, or communication purposes. RF system 500 includes a processor 502, a digital-to-analog converter (DAC) 504, RF front end circuitry 506, an analog-to-digital converter (ADC) 508, and antenna structure 510. In some cases, any of processor 502, DAC 504, RF front end circuitry 506, or ADC 508 is implemented as a system-on-chip, or a chip set populated on a printed circuit board (PCB) which may in turn be populated into a chassis of a multi-chassis system or an otherwise higher-level system, although any number of implementations can be used. RF system 500 may be one portion of an electronic device on board aerodynamic system 100 that sends and/or receives RF signals. RF system 500 is illustrated as a transceiver system with both RF transmission and RF reception capability. However, in some embodiments, RF system 500 is a transmitter only and thus does not include ADC 508. In some other embodiments, RF system 500 is a receiver only and thus does not include DAC 504. Any of the elements of RF system 500 can be included within fuselage 102 and/or within the cavity where RF transmitter 108 is located in the example embodiment shown in FIGS. 1A-C. In some such examples, for instance, any of the elements of RF front end 506 are included within the cavity or portion of fuselage 102 under tailfin structure 106 at second end 105 of fuselage 102.

Processor 502 may be configured to generate and/or receive digital signals to be used for communication or guidance purposes. As used herein, the term "processor" may refer to any device or portion of a device or combination of devices that processes electronic data from registers and/or memory to transform that electronic data into other electronic data that may be stored in registers and/or memory. Processor 502 may include, for example, one or more digital signal processors (DSPs), application-specific integrated circuits (ASICs), central processing units (CPUs), custom-built semiconductor, or any other suitable processing devices.

DAC 504 may be implemented to receive a digital signal from processor 502 and convert the signal into an analog signal that can be transmitted via antenna structure 510. DAC 504 may be any known type of DAC without limitation. In some embodiments, DAC 504 has a linear range of between about 5 GHz and about 50 GHz, and the input resolution is in the range of 6 to 12 bits, although the present disclosure is not intended to be limited to such specific implementation details.

RF front end circuitry 506 may include various components that are designed to filter, amplify, and tune selected portions of a received analog signal from either antenna structure 510 or DAC 504, according to an embodiment. RF front end circuitry may be designed to have a high dynamic range that can tune across a wide bandwidth of frequencies. For example, RF front end circuitry 506 may include components that are capable of tuning to particular frequency ranges within a signal having a bandwidth in the gigahertz range, such as bandwidths between 5 GHz and 50 GHz. In some embodiments, RF front end circuitry 506 modulates the received AC signal from DAC 504 onto a lower frequency carrier signal. In some embodiments, RF front end circuitry 506 receives an analog signal from antenna structure 510 and performs one or more of demodulation, filtering, or amplification of the received signal. In some embodiments, RF front end circuitry 506 includes one or more integrated circuit (IC) chips packaged together in a system-in-package (SIP).

ADC 508 may be implemented to receive an analog signal from RF front end circuitry 506 and convert the signal into a digital signal that can be received by processor 502 for further analysis. ADC 508 may be any known type of ADC without limitation. In some embodiments, ADC 508 has a linear range of between about 5 GHz and about 50 GHz, and the input resolution is in the range of 6 to 12 bits, although the present disclosure is not intended to be limited to such specific implementation details.

Antenna structure 510 receives the RF signal from RF front end circuitry 506 and transmits the signal out and away from aerodynamic system 100, according to some embodiments. In some embodiments, antenna structure 510 receives RF radiation impinging upon aerodynamic system 100 and converts the received RF radiation to an analog signal that is received by RF front end circuitry 506. Antenna structure 510 may represent any number of physical antennas located at any portion of aerodynamic system 100.

Further Example Embodiments

The following examples pertain to further embodiments, from which numerous permutations and configurations will be apparent.

Example 1 is an aerodynamic system that includes a fuselage having a cylindrical shape with a first end and an opposite second end, a nosecone coupled to the first end of the fuselage, and a tailfin structure. The tailfin structure includes a cylindrical wall, an inner plate coupled to an inner surface of the cylindrical wall, and a plurality of tailfin panels coupled to an outer surface of the cylindrical wall. The tailfin structure is shaped to fit over the second end of the fuselage such that the cylindrical wall wraps around a portion of a length of the fuselage extending from the second end of the fuselage towards the first end of the fuselage.

Example 2 includes the subject matter of Example 1, wherein the nosecone has a blunted tip.

Example 3 includes the subject matter of Example 1 or 2, wherein the nosecone has a circular front-facing surface with a radius that is about half a radius of a cross-section across the fuselage.

Example 4 includes the subject matter of any one of Examples 1-3, wherein the fuselage has a diameter in the range of 1 inch to 3 inches.

Example 5 includes the subject matter of any one of Examples 1-4, wherein the nosecone comprises tungsten or a tungsten alloy.

Example 6 includes the subject matter of any one of Examples 1-5, wherein the nosecone comprises a tungsten or a tungsten alloy base material and a polymer layer over the tungsten or a tungsten alloy base material.

Example 7 includes the subject matter of any one of Examples 1-6, wherein the tailfin structure comprises eight tailfin panels.

Example 8 includes the subject matter of any one of Examples 1-7, further comprising one or more electrical components at least partly disposed within a cavity of the tailfin structure.

Example 9 includes the subject matter of any one of Examples 1-8, wherein the tailfin structure comprises a unitary mass of aluminum, and each of the cylindrical wall, the inner plate, and the tailfin panels are part of the unitary mass.

Example 10 includes the subject matter of any one of Examples 1-9, wherein the cylindrical wall comprises one or more openings cut into a portion of the cylindrical wall that rests against the fuselage.

Example 11 includes the subject matter of any one of Examples 1-10, wherein at least a portion of a first surface of the inner plate contacts the second end of the fuselage.

Example 12 includes the subject matter of any one of Examples 1-11, wherein the inner plate comprises one or more through holes.

Example 13 includes the subject matter of Example 12, further comprising a communication device coupled to a second surface of the inner plate opposite to the first surface, wherein one or more wires coupled to the communication device are fed through the one or more through holes and into the fuselage, wherein the communication device includes a transmitter and/or a receiver.

Example 14 includes the subject matter of any one of Examples 1-13, wherein the tailfin structure further comprises a backplate coupled to one end of the cylindrical wall, and the plurality of tailfin panels are coupled to the backplate.

Example 15 includes the subject matter of Example 14, wherein the backplate comprises one or more hinged wings.

Example 16 is an aerodynamic system that includes a fuselage having a cylindrical shape with a first end and an opposite second end, a nosecone coupled to the first end of the fuselage, and a tailfin structure comprising a plurality of tailfin panels at the second end of the fuselage. The fuselage has a first diameter and the nosecone has a circular front-facing surface with a second diameter that is about half of the first diameter.

Example 17 includes the subject matter of Example 16, wherein the tailfin structure further comprises a cylindrical wall and an inner plate coupled to an inner surface of the cylindrical wall, wherein the tailfin structure is shaped to fit over the second end of the fuselage such that the cylindrical wall wraps around a portion of a length of the fuselage extending from the second end of the fuselage towards the first end of the fuselage.

Example 18 includes the subject matter of Example 17, further comprising one or more electrical components disposed within a cavity of the tailfin structure.

Example 19 includes the subject matter of Example 17 or 18, wherein the cylindrical wall comprises one or more openings cut into a portion of the cylindrical wall that rests against the fuselage.

Example 20 includes the subject matter of any one of Examples 17-19, wherein at least a portion of a first surface of the inner plate contacts the second end of the fuselage Example 21 includes the subject matter of any one of Examples 17-20, wherein each of the cylindrical wall, the inner plate, and the plurality of tailfin panels are part of a single piece of material Example 22 includes the subject matter of any one of Examples 17-21, wherein the inner plate comprises one or more through holes.

Example 23 includes the subject matter of Example 22, further comprising a transmitter device coupled to a second surface of the inner plate opposite to the first surface, wherein one or more wires coupled to the transmitter device are fed through the one or more through holes and into the fuselage.

Example 24 includes the subject matter of any one of Examples 16-23, wherein the first diameter is in the range of 1 inch to 3 inches.

Example 25 includes the subject matter of any one of Examples 16-24, wherein the nosecone comprises tungsten.

Example 26 includes the subject matter of any one of Examples 16-25, wherein the nosecone comprises a tungsten base material and a polymer layer over the tungsten base material.

Example 27 includes the subject matter of any one of Examples 16-26, wherein the tailfin structure comprises eight tailfin panels.

Example 28 is a tailfin kit assembly that includes a tailfin structure and one or more fasteners to couple the tailfin structure to the end of a rocket fuselage. The tailfin structure includes a cylindrical wall, an inner plate coupled to an inner surface of the cylindrical wall, and a plurality of tailfin panels coupled to an outer surface of the cylindrical wall. The tailfin structure is shaped to fit over an end of the rocket fuselage such that the cylindrical wall wraps around a portion of a length of the fuselage extending from one end of the fuselage towards an opposite end of the fuselage.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

What is claimed is:

1. An aerodynamic system, comprising:

a fuselage having a cylindrical shape with a first end and an opposite second end;

a nosecone coupled to the first end of the fuselage; and a tailfin structure comprising a cylindrical wall, an inner plate coupled to an inner surface of the cylindrical wall, and a plurality of tailfin panels coupled to an outer surface of the cylindrical wall, wherein the tailfin structure is shaped to fit over the second end of the fuselage such that the cylindrical wall wraps around a portion of a length of the fuselage extending from the second end of the fuselage towards the first end of the fuselage wherein the tailfin structure further comprises a backplate coupled to one end of the cylindrical wall, and the plurality of tailfin panels are coupled to the backplate.

2. The aerodynamic system of claim 1, wherein the nosecone has a circular front-facing surface with a radius that is about half a radius of a cross-section across the fuselage.

3. The aerodynamic system of claim 1, wherein the fuselage has a diameter in the range of 25.4 millimeters (1 inch) to 76.2 millimeters (3 inches).

4. The aerodynamic system of claim 1, wherein the nosecone comprises a tungsten or a tungsten alloy base material and a polymer layer over the tungsten or a tungsten alloy base material.

5. The aerodynamic system of claim 1, further comprising one or more electrical components at least partly disposed within a cavity of the tailfin structure.

6. The aerodynamic system of claim 1, wherein the tailfin structure comprises a unitary mass of aluminum, and each of the cylindrical wall, the inner plate, and the tailfin panels are part of the unitary mass.

7. The aerodynamic system of claim 1, wherein the cylindrical wall comprises one or more openings cut into a portion of the cylindrical wall that rests against the fuselage.

8. The aerodynamic system of claim 1, wherein the inner plate comprises one or more through holes.

9. The aerodynamic system of claim 8, further comprising a communication device coupled to a second surface of the inner plate opposite to a first surface of the inner plate, wherein one or more wires coupled to the communication device are fed through the one or more through holes and into the fuselage, wherein the communication device includes a transmitter and/or a receiver.

10. The aerodynamic system of claim 1, wherein the backplate comprises one or more hinged wings.

11. An aerodynamic system, comprising:

a fuselage having a cylindrical shape with a first end and an opposite second end, the fuselage having a first diameter;

a nosecone coupled to the first end of the fuselage, wherein the nosecone has a circular front-facing surface with a second diameter that is about half of the first diameter; and a tailfin structure comprising a cylindrical wall, and a plurality of tailfin panels at the second end of the fuselage, wherein the tailfin structure further comprises a backplate coupled to one end of the cylindrical wall, and the plurality of tailfin panels are coupled to the backplate.

12. The aerodynamic system of claim 11, wherein the tailfin structure further comprises a cylindrical wall and an inner plate coupled to an inner surface of the cylindrical wall, wherein the tailfin structure is shaped to fit over the second end of the fuselage such that the cylindrical wall wraps around a portion of a length of the fuselage extending from the second end of the fuselage towards the first end of the fuselage.

13. The aerodynamic system of claim 12, further comprising one or more electrical components disposed within a cavity of the tailfin structure.

14. The aerodynamic system of claim 12, wherein the cylindrical wall comprises one or more openings cut into a portion of the cylindrical wall that rests against the fuselage.

15. The aerodynamic system of claim 12, wherein each of the cylindrical wall, the inner plate, and the plurality of tailfin panels are part of a single piece of material.

16. The aerodynamic system of claim 12, wherein the inner plate comprises one or more through holes.

17. The aerodynamic system of claim 16, further comprising a transmitter device coupled to a second surface of the inner plate opposite to a first surface of the inner plate, wherein one or more wires coupled to the transmitter device are fed through the one or more through holes and into the fuselage.

18. The aerodynamic system of claim 11, wherein the nosecone comprises a tungsten base material and a polymer layer over the tungsten base material.

19. A tailfin kit assembly, comprising:

a tailfin structure having a cylindrical wall, an inner plate coupled to an inner surface of the cylindrical wall, and a plurality of tailfin panels coupled to an outer surface of the cylindrical wall, wherein the tailfin structure is shaped to fit over an end of a rocket fuselage such that the cylindrical wall wraps around a portion of a length of the fuselage extending from one end of the fuselage towards an opposite end of the fuselage, wherein the tailfin structure further comprises a backplate coupled to one end of the cylindrical wall, and the plurality of tailfin panels are coupled to the backplate; and one or more fasteners to couple the tailfin structure to the end of the rocket fuselage.

* * * * *